United States Patent [19]

Wooding

[11] 4,202,997

[45] May 13, 1980

[54] ATMOSPHERIC CONTROL OF FLUX PRE-MELTING FURNACE

[75] Inventor: Patrick J. Wooding, Moorestown, N.J.

[73] Assignee: Wooding Corporation, Moorestown, N.J.

[21] Appl. No.: 773,263

[22] Filed: Mar. 1, 1977

[51] Int. Cl.[2] ..... F27D 7/06

[52] U.S. Cl. ..... 13/31 R; 13/9 ES

[58] Field of Search ..... 13/9 ES, 10, 31

[56] References Cited

U.S. PATENT DOCUMENTS

| | | | |
|---|---|---|---|
| 2,996,559 | 8/1961 | Gruber et al. | 13/31 X |
| 3,973,076 | 8/1976 | Scott et al. | 13/10 X |

*Primary Examiner*—Roy N. Envall, Jr.
*Attorney, Agent, or Firm*—Duffield & Lehrer

[57] ABSTRACT

A graphite lined crucible includes an upper horizontally extending flange having a seal ring around its periphery. The crucible may be raised by a hydraulic cylinder so as to bring the seal ring into engagement with the inside of a refractory lined roof. Electrodes supported by the roof extend downwardly into the crucible for melting the flux within the crucible. The roof and the crucible are air-tight thereby preventing air from entering the crucible. An exhaust port located in the upper portion of the roof is connected to a vacuum device for exhausting fumes from the crucible and for controlling the atmosphere within the crucible.

15 Claims, 3 Drawing Figures

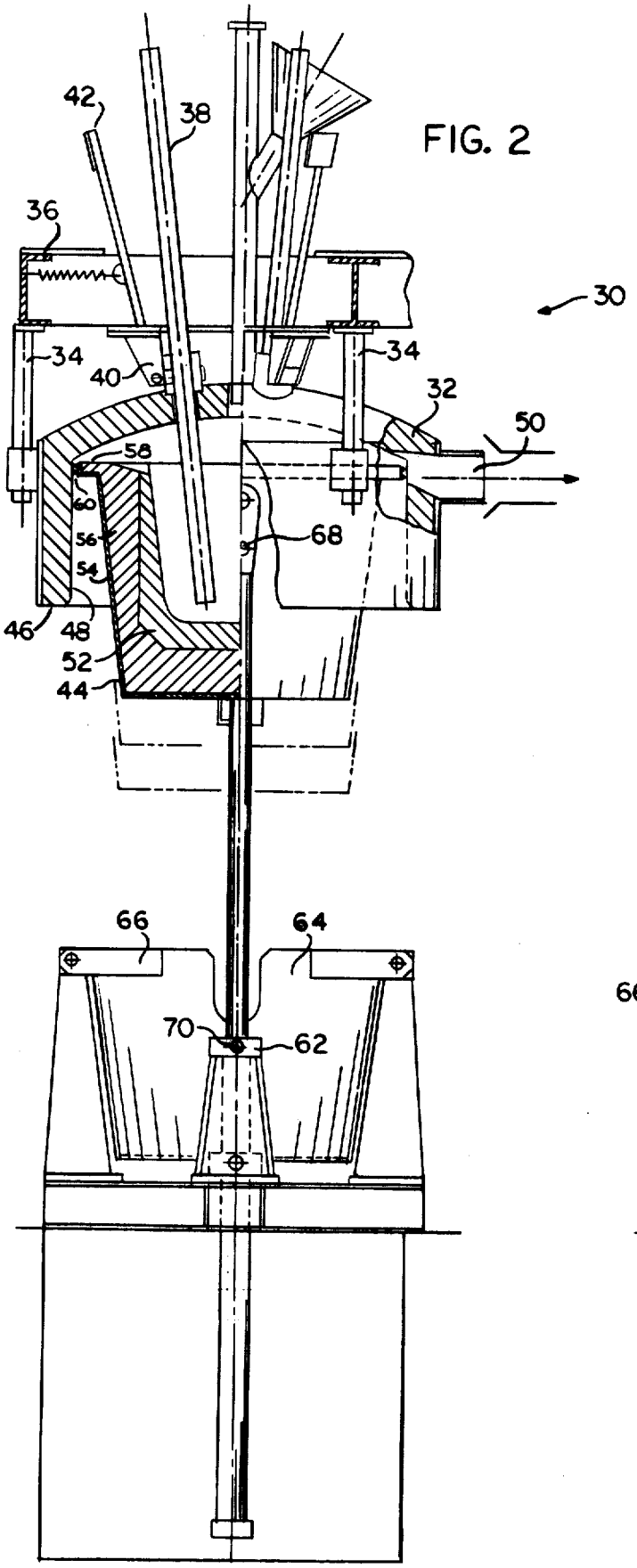
FIG. 2
FIG. 3
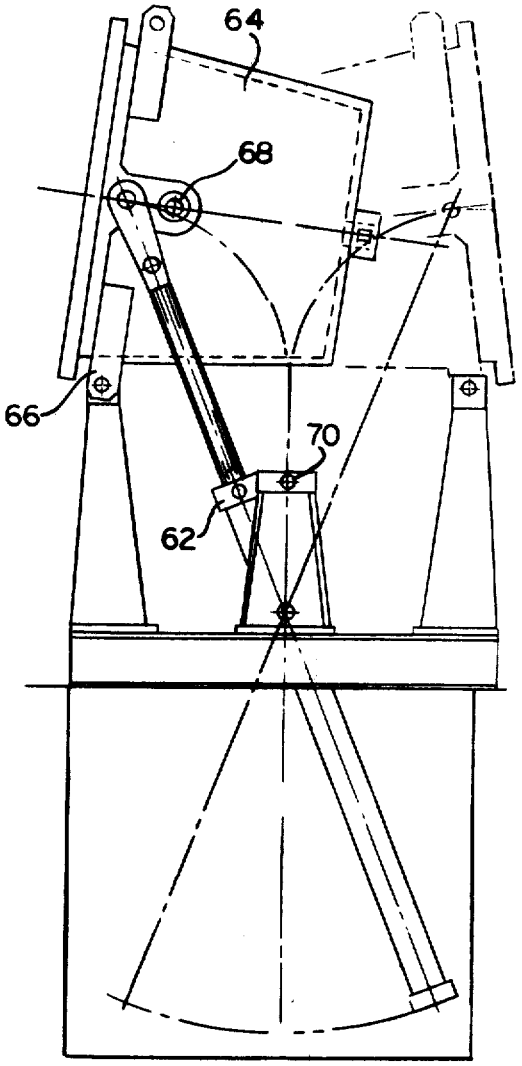

ATMOSPHERIC CONTROL OF FLUX PRE-MELTING FURNACE

BACKGROUND OF THE INVENTION

The present invention is directed toward an electroslag pre-melting furnace and more particularly toward a pre-melting furnace which includes means for controlling the atmosphere therein.

The electroslag melting process was first invented, developed and put into full production by R. K. Hopkins in the United States during the period between 1930 and 1960. This process employs a consumable electrode which is immersed in a pool of molten slag supported at the top of the resultant solidifying ingot enclosed within a cold-walled mold or crucible.

Alternating (or sometimes direct) current flows down the consumable electrode through the slag, down the ingot and back to the power supply. Preferably, the current flows back to the power supply in a coaxial manner to the top of the crucible such as shown in co-pending application Ser. No. 616,365 filed Sept. 24, 1975, now U.S. Pat. No. 4,032,705. This current, normally in the range of 1,000 amps per inch of ingot diameter, drops from fifteen to forty volts across the slag (or flux) pool thereby producing hundreds of kilowatts of melting power which consumes the tip of the electrode.

As a result of the foregoing, molten metal droplets form on the immersed electrode tip, detach themselves and fall through the molten flux pool to the ingot which is forming there below. As the metal droplets pass through the flux pool, they undergo chemical refinement. Progressive solidification of the ingot formed by this method leads to the physical isotropy and high yield associated with all consumable electrode processes.

As is known in the art, most electroslag ingots of 24 inch diameter and larger are started by pre-melting a slag of suitable chemistry and pouring a six to eight inch deep pool of this molten slag into the bottom of the crucible. The electrode tip is then immersed to a depth of a half an inch or so into this molten pool. The melting current flowing through the molten flux raises its temperature until the electrode begins to melt.

Molten flux (or slag) starting, as this technique is known, gives much higher utilization of the consumable (electroslag) furnace and better ingot yield than "dry" or cold starting because ingot bottom losses are minimized.

In the past, flux pre-melting furnaces have always been open to the atmosphere. These have consisted primarily of air induction furnaces with the graphite crucible acting as a susceptor. More recently, A. C. resistance furnaces have been employed. These include one or more graphite electrodes in a single phase system, or three electrodes in a three phase system for larger units, which electrodes function as submerged melters in a graphite monolithic crucible or graphic brick lining.

These prior art systems, however, have several serious drawbacks. For example, at elevated temperatures (most electroslag fluxes have melting points in the 2,500° to 3,500° F. range) and in the presence of air (or oxygen) graphite erodes quite rapidly which leads to low heat life of the crucibles (20 to 30 heats) and frequent electrode replacement.

Even worse, a substantial part of the eroded graphite, from both the lining and the electrodes, dissolves in the molten flux. It is then poured into the electroslag crucible and is transferred to the bottom few inches of the ingot being built up. In the case of a low carbon alloy steel heat, carbon pick-up from this source can easily scrap all or part of the ingot.

SUMMARY OF THE INVENTION

The present invention overcomes the above-described deficiencies in the prior art by providing a graphite lined crucible which includes an upper horizontally extending flange having a sealing ring around its periphery. The crucible can be raised by a hydraulic cylinder so as to bring the sealing ring into engagement with the inside of a refractory lined roof. Electrodes supported by the roof extend down into the crucible for melting the flux within the crucible. The roof and crucible are air-tight to prevent air from entering the crucible. An exhaust port located in the upper portion of the roof is connected to a vacuum pump or similar device for exhausting the fumes from the crucible and for controlling the atmosphere therein. As a result, electrode and crucible erosion are sharply reduced and carbon pick-up in the molten starting flux is virtually eliminated.

BRIEF DESCRIPTION OF THE DRAWINGS

For the purpose of illustrating the present invention, there is shown in the accompanying drawings one form which is presently preferred; it being understood that the invention is not intended to be limited to the precise arrangements and instrumentalities shown.

FIG. 2 is a front elevational view, partially in section, of a flux pre-melting furnace constructed in accordance with the principles of the present invention, and FIG. 3 is a view similar to FIG. 2 showing the manner in which the flux is poured from the crucible.

DETAILED DESCRIPTION OF THE INVENTION

Figure 1:
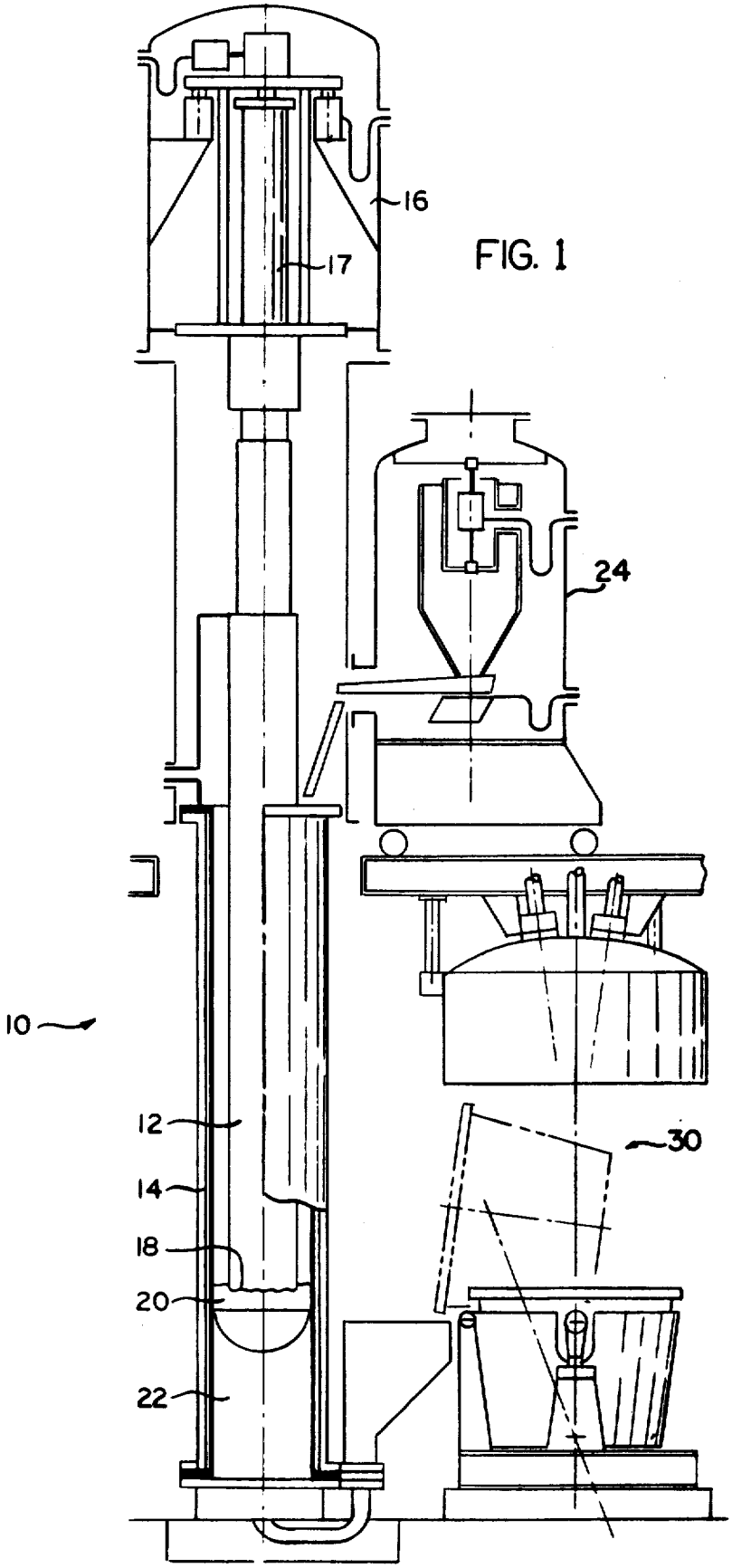
FIG. 1 is an elevational view showing the general arrangement and various components of an electroslag melting system.

Referring now to the drawings in detail wherein similar reference numerals have been used throughout the several figures to identify similar components, there is shown in FIG. 1 a general elevational view of an electroslag melting system and designated generally as 10.

The major components of the electroslag melting system 10 illustrated in FIG. 1 are generally known in the art. These include, for example, a consumable electrode 12 which is suspended within a crucible 14. The furnace head 16 includes a ram 17 for moving the electrode downwardly into the crucible 14 so as to maintain the tip 18 of the electrode immersed in the slag pool 20 supported by the ingot 22 being formed there below. Located to the upper side of the crucible 14 is a feeder 24 which is used to feed granular slag and alloy material to the crucible 14 to make up for the slag which is consumed during melting of the consumable electrode 12. Shown in the bottom right of FIG. 1 is a pre-melting furnace designated generally as 30 which, as is known in the art, is used to pour molten flux into the bottom of the crucible 14 for starting the electroslag operation.

With specific reference to FIG. 2, the pre-melting furnace 30 includes an air-tight refractory lined roof or cover 32 which is fixed in position by supports 34 connected to a beam 36. The roof 32 has three 3 inch diameter graphite electrodes passing therethrough, only one such electrod, 38, being shown in detail.

Electrode 38 is clamped into a sealed electrode holder 40. The extent to which the electrode 38 extends downwardly can be adjusted by use of lever 42 on holder 40. It will be understood that the second and third electrodes are similarly supported by similar electrode holders. The three electrode holders and electrodes are mounted in a triangular pattern symmetrical around the vertical axis of the roof 32.

The three electrodes are inclined slightly toward each other so that their lower ends would touch if the electrodes were slipped downwardly through the holders to an elevation corresponding to the lowest melting position of the bottom of the crucible 44. The roof 32 includes a downwardly extending cylindrical wall portion 46 having an inner surface 48. The roof 32 also includes a port 50 extending through the wall of the roof adjacent the upper part thereof.

Located beneath the roof 32 is the crucible 44. Crucible 44 includes a graphite crucible section 52 which is separated from an outer steel shell 54 of air-tight construction by a refractory/insulation layer 56. As shown in FIG. 2, the angle of the electrode inclination corresponds with the inverted cone shape of the graphite portion 52 of the crucible 44.

Adjacent the upper end of the cricible 44 is a horizontally extending flange 58. A plurality of air-tight sealing rings such as shown at 60 surround the outer peripheral portion of the flange 58. These are adapted to engage the inner surface 48 of the roof 32 so as to form a seal there between.

By presetting the bases of the electrodes at a distance of approximately two to eight inches apart, immersed electrode resistance melting of the flux located within the crucible 44 is achieved by raising and lowering the crucible. This is accomplished by means of hydraulic cylinders 62. The melting current is thus regulated by the degree of the immersion of the electrodes. This is accomplished without breaking the seal between the horizontal flange 58 and the inside surface 48 of the roof 32.

During the melting of the flux, an evacuation device (not shown) may be connected to the port 50 to remove the fumes which form in the pre-melting furnace 30 and to prevent oxygen or other detrimental from entering. It should be understood that a high-velocity fan-powered venturi could be employed if only substantial atmosphere control were desired or a more powerful vacuum system could be employed if complete atmosphere control were desired.

Delivery of molten flux is achieved by lowering the crucible 44 into the support cradle 64, locking the crucible into the cradle by use of locks 66 and releasing pins 68 and 70 which ensured vertical motion of the crucible during melting. Thereafter, the hydraulic cylinder 62 is again extended causing the crucible 44 to tilt as shown in FIG. 3 thereby pouring the flux within the crucible 44 into the electroslag melting crucible 14.

The present invention may be embodied in other specific forms without departing from the spirit or essential attributes thereof and, accordingly, reference should be made to the appended claims, rather than to the foregoing specification as indicating the scope of the invention.

I claim:

1. In a flux pre-melting furnace for use with an electroslag melting furnace wherein said pre-melting furnace includes a refractory lined crucible and a plurality of graphite electrodes adapted to be inserted into said crucible, the improvement comprising cover means for said crucible, means for creating a seal between said cover means and said crucible and means for controlling the atmosphere within said crucible by removing oxygen therefrom.

2. The improvement as claimed in claim 1 wherein said electrodes pass through and are supported by said cover means and wherein said crucible is graphite lined.

3. The improvement as claimed in claim 1 wherein said means for creating a seal includes a flange adjacent the top of said crucible and a sealing ring surrounding said flange.

4. The improvement as claimed in claim 3 wherein said cover means includes substantially cylindrical side walls which are adapted to cooperate with said sealing ring.

5. The improvement as claimed in claim 1 wherein said cover means is rigidly mounted above said crucible and further including means for moving said crucible from a first positon where it does not cooperate with said cover means to a second position wherein said crucible cooperates with said cover means to form said seal.

6. The improvement as claimed in claim 1 wherein said crucible and said cover means are movable toward and away from each other while maintaining said seal between said cover means and said crucible.

7. The improvement as claimed in claim 1 further including means for allowing the molten contents of said crucible to be poured therefrom.

8. In a process for melting slag, the steps of placing the slag in a refractory lined crucible, covering said crucible and heating said slag by passing an electric current through said slag with the use of a plurality of graphite electrodes while controlling the atmoshpere within said crucible by removing oxygen and other detrimental gases from said crucible.

9. In a process as set forth in claim 8 further including the step of pouring the molten slag from said crucible.

10. In a process for melting slag, the steps of placing the slag in a refractory lined crucible, covering said crucible and heating said slag by passing an electric current through said slag with the use of a plurality of graphite electrodes while controlling the atmoshpere within said crucible by creating a vacuum within said crucible.

11. In a process as set forth in claim 10 further including the step of pouring the molten slag from said crucible.

12. An electric furnace for melting slag comprising a crucible and a cover means for said crucible adapted to cooperate therewith, said crucible including a refractory liner therein; a plurality of graphite electrodes extending into the interior of said crucible; means for creating a seal between said cover means and said crucible and means for controlling the atmosphere within said crucible by removing oxygen therefrom.

13. The furnace as claimed in claim 12 wherein said electrodes pass through and are supported by said cover means and wherein said crucible is graphite lined.

14. The furnace as claimed in claim 12 wherein said crucible and said cover means are movable toward and away from each other while maintaining said seal between said cover means and said crucible.

15. The furnace as claimed in claim 12 further including means for allowing the molten contents of said crucible to be poured therefrom.

* * * * *